United States Patent [19]

Unger et al.

[11] Patent Number: 4,782,747

[45] Date of Patent: Nov. 8, 1988

[54] ROLL PRESS FOR RECOVERING LIQUID FROM PULP

[76] Inventors: Daniel D. Unger, 330 W. Sixth St.; Gregory T. Unger, 309 W. Sixth St., both of Boyertown, Pa. 19512

[21] Appl. No.: 940,630

[22] Filed: Dec. 11, 1986

[51] Int. Cl.[4] ..... B30B 5/02; B30B 9/22

[52] U.S. Cl. ..... 100/37; 100/110; 100/112; 100/116; 100/121; 100/211; 100/295

[58] Field of Search ..... 100/110, 116, 121, 210, 100/37, 131, 295, 211, 122, 112, 104, 176; 210/350, 351

[56] References Cited

U.S. PATENT DOCUMENTS

| | | | |
|---|---|---|---|
| 3,693,540 | 9/1972 | Dambrine | 100/110 |
| 4,350,089 | 9/1982 | Braun | 100/211 X |
| 4,387,634 | 6/1983 | Balass | 100/211 |

FOREIGN PATENT DOCUMENTS

| | | | |
|---|---|---|---|
| 1193010 | 11/1985 | U.S.S.R. | 100/116 |

*Primary Examiner*—Andrew M. Falik

*Attorney, Agent, or Firm*—Leonard M. Quittner

[57] ABSTRACT

A continuous device and process for extracting liquid from mash, sludge or pulp bearing slurries. The device comprises a pair of parallel opposed and counter rotating rolls each consisting of a base roll member having circumferentially disposed grid member consisting of a multiplicity of upright standing leaves which interbolt to form a grid which encases the entire surface of the roll member. Raw material for deliquification is spread over the grid and compressed by an inflatable, reciprocating platen to express liquid through the grid into underlying collection channels. The rolls are then rotated toward each other to express additional liquid and produce a substantially dry material. The liquid collected in the collection channels is withdrawn by applying a negative pressure through orifices located at the axial extent of the rolls.

11 Claims, 7 Drawing Sheets

FIG. 5
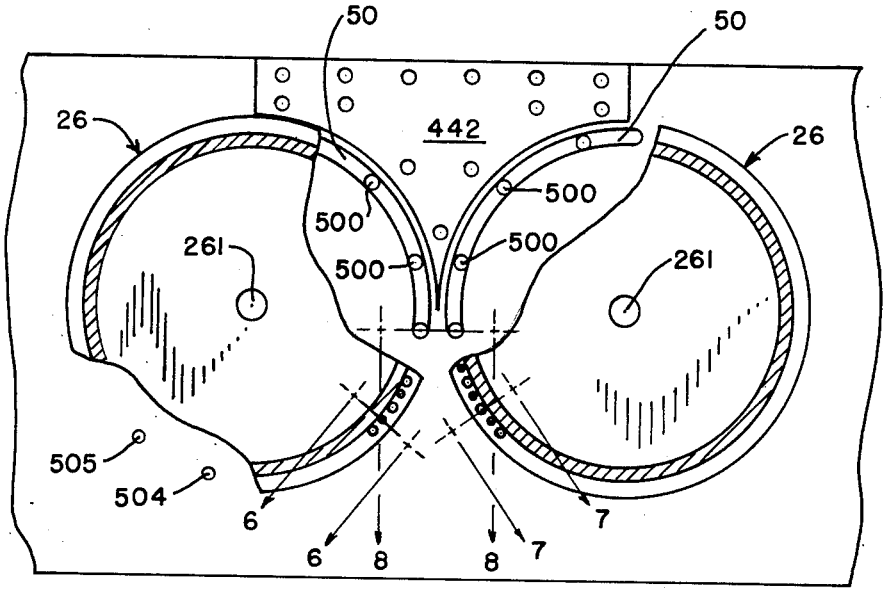
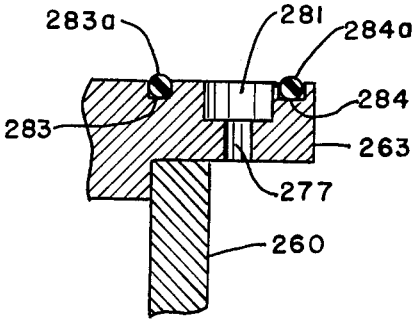
FIG. 6
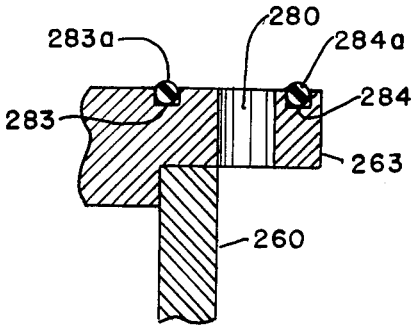
FIG. 7
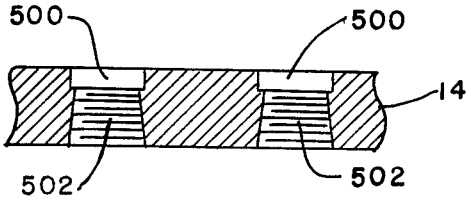
FIG. 8

ROLL PRESS FOR RECOVERING LIQUID FROM PULP

BACKGROUND OF THE INVENTION

1. The Field of the Invention

The field of the invention relates to an improved extractor and method for extraction of liquid from mashes, sludges or pulp bearing slurries.

2. Description of the Prior Art

The prior art is typified by several methods of and devices for extraction, expressment or deliquification of mashes, sludges or pulp bearing slurries. Generally speaking four categories are perceived. Oldest is the screw type press in which mash, the macerated, chopped or otherwise dismembered animal or vegetable material (apples, grapes, corn, fish) or biodegradable waste is placed in a drum or barrel-like container and compressed by a downwardly directed platen attached to a feed screw. Liquid, i.e. juice, oil, water, is exuded or expressed therefrom by pressure and drained off through perforations in the barrel or through slats. U.S. Pat. Nos. 332,044 to Caldwell, et. al. (1861) and 48,657 to Clayton, et. al. (1865) are typical of the kind. Another major type of extraction system involves disposition of the mash into a tapered feed screw which passes the mash through compression members which apply exudation pressure or expressing force to the liquid bearing material and cause the dried residue to be expelled continuously from the tapered end of the screw as gravity removes the liquid portion. U.S. Pat. No. 19,421 to Helton (1858); U.S. Pat. No. 508,958 to Middleton (1893); U.S. Pat. No. 2,360,984 to Schmitz (1942); U.S. Pat. No. 3,207,061 to Zaromb (1965) and U.S. Pat. No. 4,385,553, to Ihara (1983) typify this configuration. Manufacturers such as Vetters, Reitz, Jones and Sajo are representative of current commercial suppliers of this technology. Other advanced modern devices dealing with mash, as well suited to sludges and pulp bearing slurries, utilize intermittently bolted porous transport belts or those which move continuously. The material to be deliquified, carried on the belt, is compressed in sections intermittently by halting the belt in a defined deliquification zone, and downwardly directing reciprocating platen of a given size over a liquid collector which receives the expressed portion leaving dry residue on the belt. In a variation the belts may be driven continuously between pressure rolls. The products of Bucher-Guyer, SA, Niederweningen, Switzerland, see, a typical, U.S. Pat. Nos. 3,207,064, 3,541,951 and 3,951,058, all to Bucher-Guyer and 4,586,430 (1986) assigned to Atlas Pacific, are prominent. U.S. Pat. No. 235,198 to Bell (1880); the work of Vernsten set forth in U.S. Pat. Nos. 921,921 (1909) and 1,032,167 (1912); U.S. Pat. No. 1,296,112 to Peiler (1919); U.S. Pat. No. 1,798,555 to Pipkin (1930); and U.S. Pat. No. 3,273,492 to Justus (1966) are of interest. In this configuration the liquid is exuded through porosities in the belt in to a collector and the dried residue is scraped from the belt. In the case of pomace, to improve yield and prevent circular shear, additives called press aids such as rice hulls, shredded paper or other fibrous materials are mixed with the mash, prior to compression. Other methods utilize rotating drums of various configurations to accomplish expressment of the liquid into the drum's interior for collection such as U.S. Pat. No. 670,963 to Logemann, et. al. (1901); U.S. Pat. Nos. 1,238,289 to Hare (1917) and 3,478,796 to Rafanelli (1969) or the reverse, e.g. loading the drum interiorly and by rotary or compression forces from within the drum causing the liquid to be exuded exteriorly for collection with the dried residue removed from the drum in batches thereafter. See U.S. Pat. No. 4,191,103 to Wettlaufer and the products of Bucher-Guyer as typified in U.S. Pat. Nos. 4,106,404, 4,273,000, 4,837,634, 4,607,570, 4,410,051 and 4,151,785, all to Bucher-Guyer. U.S. Pat. No. 2,099,739 to Jenkins (1937) shows rolls inside one another to accomplish a similar purpose.

Passing mash between a driver roll and a counter-rotating hard surfaced idler roll in which the idler roll provides exudation pressure and the driver liquid separation is also known and it is nearer in art to the singular category into which the present invention falls. '963 to Logemann, et. al., although quite old and which typifies basic unresolved problems in the prior art, discloses a spring loaded compression roll with a hard surface disposed superiorly to a receptacle roll with a perforated outer surface through which into radially disposed, shaft abutting compartments liquid is expressed from side-fed material in a hopper situated at the nip point. The compartments are partially cleared of liquid through the roll ends by suction as they pass an exit port located above the receptacle rolls' axis.

Liquid is otherwise unrestrained and can counterflow into the compartments or exteriorly by gravity during rotation. In addition, devices of the type will clog randomly if the top surface is merely an array of holes. If the surface is covered, the covering material soon loads with solids and becomes useless without down time to change it. By configuration, in the '963 type, substantial liquid must remain in each compartment or drain through the covering taking debris along with it. The surface material can never truly dry and is not susceptible to practical removal. Additionally, the shear forces from a hard compression roll will rupture cellular tissue and make for a recovered liquid with substantially turbidity.

Other dewatering arts such as is found in paper manufacture or the liquor separation and concentration utilized in the sugar cane processing art provide answers to some of the problems created in this area. None approach or solve with the effectiveness of the present invention similar problems notwithstanding their efficacy in these entirely unrelated purposes. See U.S. Pat. No. Re. 2,499 to Fassler, et. al. (1867); U.S. Pat. Nos. 949,787 to Wheat (1910) and 1,006,990 to Warren (1911). The commercial products of Atlas-Pacific, Mearelli as represented by Orchard Equipment and Supply Co., Conway, Mass. 01341, J and D Products and Wilmes also provide some insight to current practice in the mask deliquification art.

U.S. Pat. No. 817,930 to Nelson (1906); U.S. Pat. No. 1,834,852 to Kutter (1931); U.S. Pat. No. 1,908,519 to Leonard (1933); U.S. Pat. No. 3,238,866 to Strindlund (1966); U.S. Pat. No. 3,257,668 to Kusters, et. al. (1970); U.S. Pat. No. 4,378,253 to Bovet (1983); U.S. Pat. No. 4,391,026 to Casey, et al. (1983) and U.S. Pat. No. 4,559,106 to Skytta, et al. (1985) have been read with interest but are found to be unresponsive to the present claims.

Problems created by clogging of the mechanism with pulp or debris, sanitary control, batch processing, incomplete removal from the liquid of cellular material, less than satisfactory yield of expressed liquid per unit of weight and excessive shear to cellular tissue where applicable, which creates undesirable turbidity, unwanted fermentation or poor tasting liquid are current problems in the art. These are solved by the apparatus and method of the present invention.

SUMMARY OF THE INVENTION

The invention described herein is summarized first as an apparatus comprising a pair of parallel disposed and counter rotating rolls, covered with grid members made of upright leaves interbolted in staggered rows so as to create slots which lead to longitudinal channels on the leaves' undersides. Material is spread continuously and circumferentially on the grids in a layer. As the rolls are rotated toward each other an acute angle prismatically shaped reciprocating platen with inflatable bladders disposed on the prism's rectangular faces is lowered between the rolls into near contact with the layers and the bladders are timed to inflate at the platen's down stroke such that the bladders compress the mash, sludge or other solids against the grids and cause the liquid therein contained to exude or express through the gaps or slots into the channels. The collection manifold. The dried solid material is further submitted to compression when the layers compressingly meet thereafter at the nip point of the rolls and cause the last remaining liquid to exude into the channels for removal.

Second, the process consists of the steps of pumping and spreading the mash, sludge or slurry onto the surface of the grids of the invention, compressing the material with the reciprocating bladder containing platen acting between the rolls, thereby causing the liquid to flow into the channels and vacuum collecting the liquid. Thereafter as the rolls continue to rotate each channel passes by a washout port whereby wash water is injected through each channel, out through its slots to a drain to clean the channel and slots and then over blowout ports whereby each channel and its slots is blown dry with clean pressurized air or stream. It is to be noted that the leaf configuration disclosed hereinafter may be varied in thickness to alter the gap spacing which experience has shown should be varied with the kind of mash, sludge or slurry to be deliquified. In addition, it has been found that variation of the platen configuration to create different layer thicknesses of material to be deliquified is desirable. For example, coarse cellular material as in high starch containing vegetables such as corn will be best expressed through slots in the grid which are wider than those most satisfactory for apples. Such materials will also give higher yields if the material layer is thicker. For such materials a slower roll surface speed appears to yield results which are higher by weight percentage than otherwise. A worker skilled in the art will readily be able to make determinations of the type with a minimum amount of experimentation).

The present invention offers the advantages of continuous liquid exudation and separation with no cellular shear, a high yield (in apple mash often in excess of 92%) of clear liquid per unit of weight, minimum damage to cell tissue, the elimination of press aids such as rice hulls to the precompressed material, virtually dry pomace or cake as an end product, (less than 75% total moisture in cranberry juice expressment without press aids as opposed to the equivalent moisture content using press aids) complete sanitary control of the apparatus and a choice of roll configurations for vitually any animal or vegetable product or mixtures thereof in which liquid separation is required.

An object of the invention is continuously to process mash, sludge or pulp bearing slurries from the raw to the completely dry state with continuous removal of liquid therefrom.

A further object of the invention is to provide a permanent, efficient separation means of a high yield per unit of weight of clear liquid which can accommodate any mash without rupturing cellular tissue thereof by shearing action and without press aids.

A further object of the invention is to provide continuous, positive cleaning means to prevent formation of harmful bacteria and to eliminate downtime.

A further object of the invention is permitting liquid extraction at very high speed.

A further important object is to provide press aid free dried material, as in pomace, which can be recovered as a food supplement, a coloring agent or for reconstitution in other edible substances.

DESCRIPTION OF DRAWINGS

The present invention may be better understood by reference to the drawings wherein eleven (11) figures are shown on seven (7) sheets. The numbers shown on the drawings for the various parts of the invention are consistent throughout so that a number indicating a part in one drawing will indicate the same part in another drawing.

FIG. 5 shows a schematic side view of the device of the invention showing the liquid exhaust manifolds and the clean outs.

FIG. 6 is a cross-sectional view through 6—6 on FIG. 5 showing the sealing means of the end plate by its "O" ring and how the tie bolt is installed in the grid member to the end plate.

FIG. 7 is a cross-sectional view through 7—7 on FIG. 5 and shows a grid channel as it opens onto the end plate.

FIG. 8 is a cross-sectional view through 8—8 on FIG. 5 and shows the trough exit ports bored through the bulkhead.

DESCRIPTION OF THE PREFERRED EMBODIMENT

Figure 1:
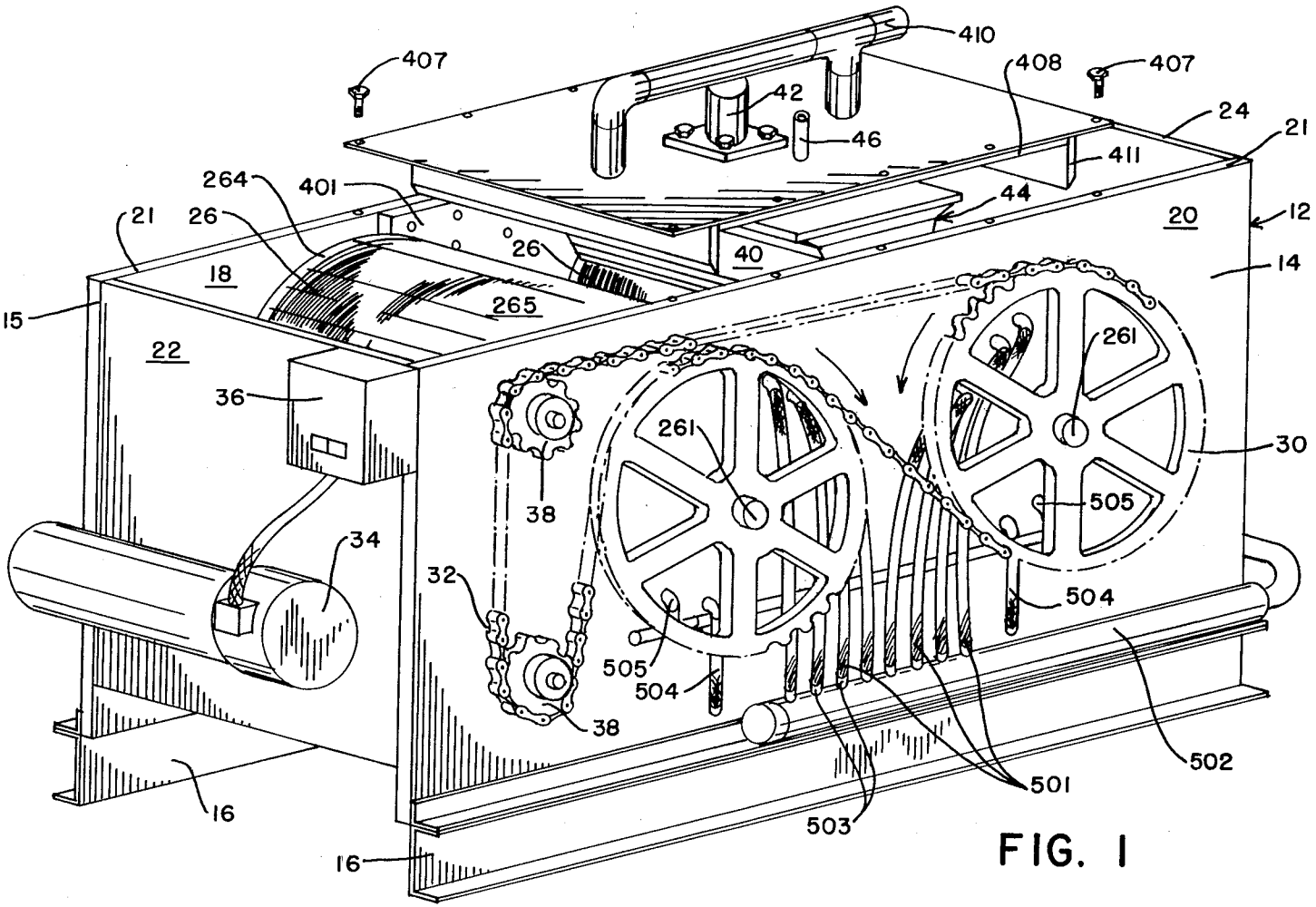
FIG. 1 shows a perspective view of the device of the invention.
Figure 4:
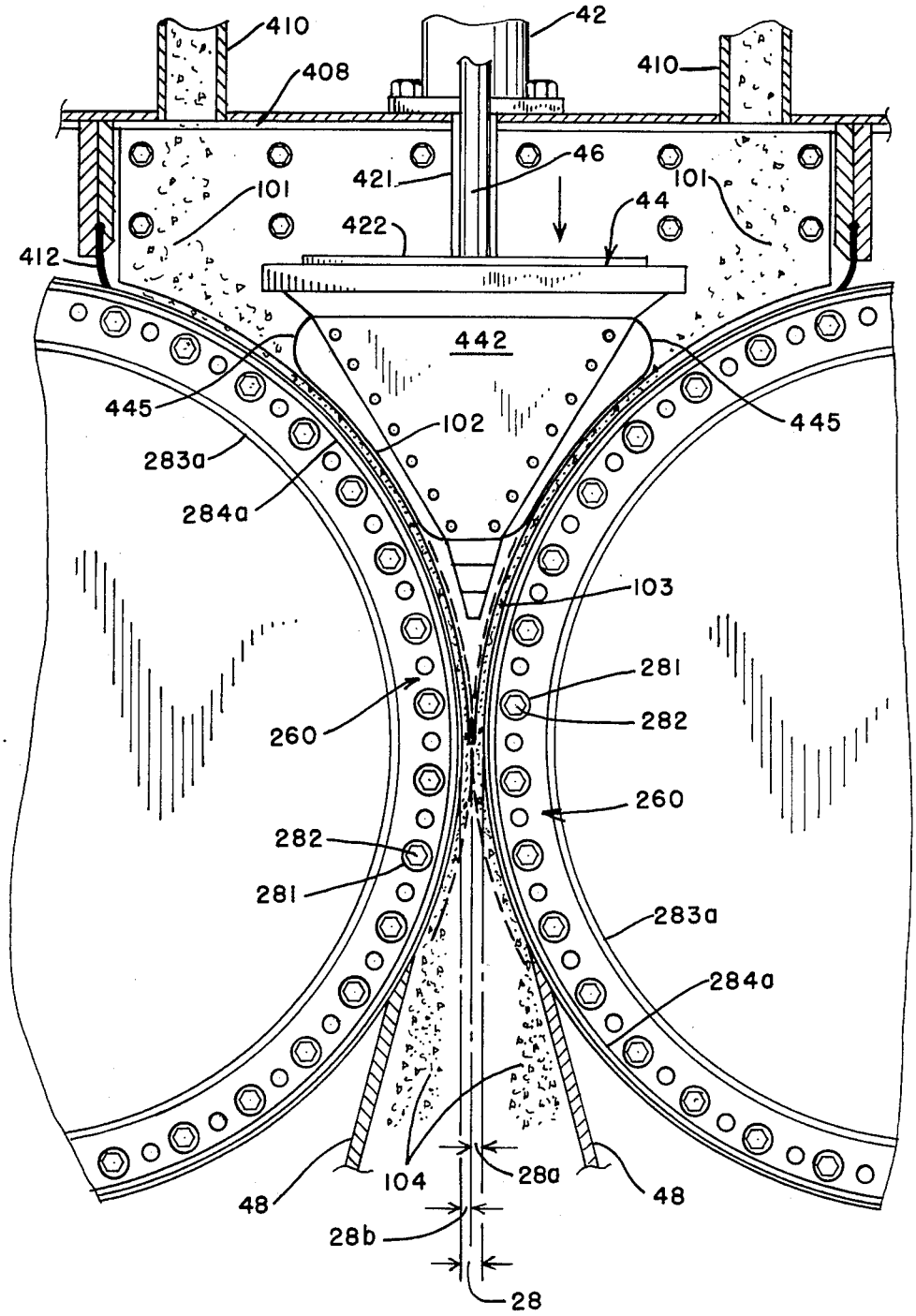
FIG. 4 shows the ends of the rolls with their end flanges installed and the platen inflated in the down position.

The device of the preferred embodiment is described as an apparatus (12) comprising first (14) and second (15) upright rectangular, longitudinally disposed, skid (16) mounted, side bulkheads, each having an inner surface (18) and an outer surface (20) and a top (21) and held apart by rectangular front (22) and rear (24) bulkheads to form an open topped box. See FIG. 1. Housed in the box perpendicular to the side bulkheads and mounted therethrough on bushings (not shown) are a pair of identical, counter rotating parallel disposed roll assemblies (26) on shafts (261) as in FIG. 1, which extend through the bushings and located such that the roll assemblies are separated by a nip distance (28) apart defined by the thickness of the layers (28*a*, 28*b*) of substantially dry material (103) spread and compressed thereon such that the layers compressingly contact each other. See FIG. 4. Fitted on the shafts' end portions are sprocket drivers (30) which are chain (32) driven by a variable speed motor (34) and control means (36) and intervening idler sprockets (38) to cause the roll assemblies to rotate toward each other at a speed selected to best meet the requirements of the type of material being processed. Typically the rolls will rotate at 0.25 r.p.m. or 1.7 surface feet per minute for apple or cranberry mash on rolls of 26 inch outside diameter.

Figure 3:
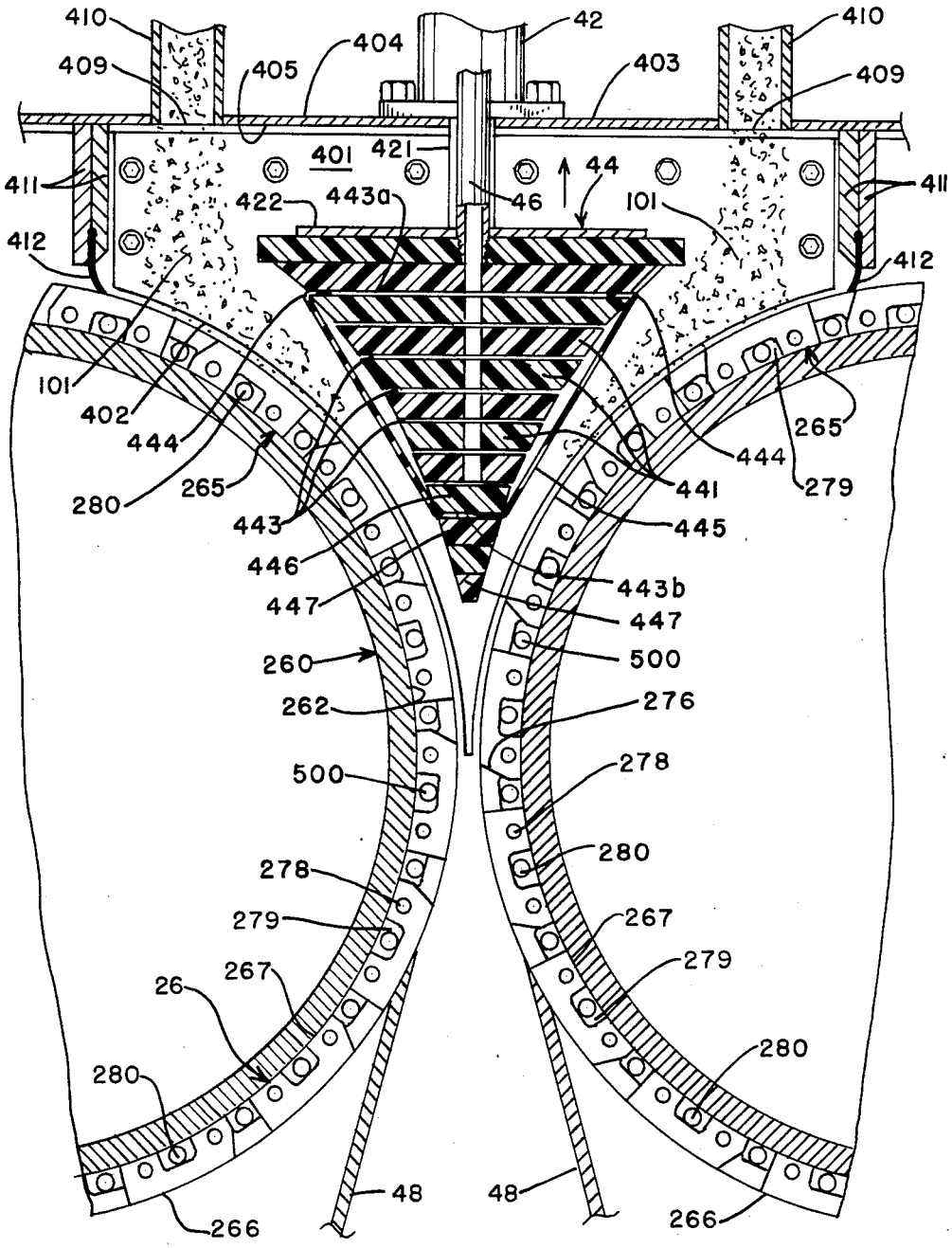
FIG. 3 is a section 3—3 on FIG. 2 and shows an end view of the rolls with their end plates removed and a cross-section of the platen uninflated in the up position.
Figure 9:
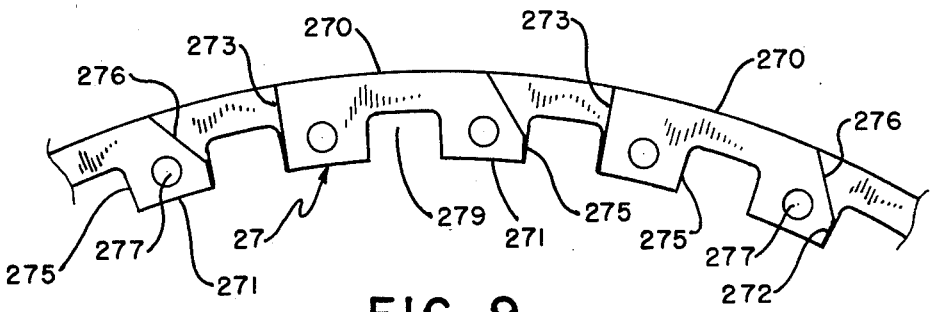
FIG. 9 shows a side elevation of the leaves as they are mounted alternately circumferentially on the base roll member.
Figure 10:
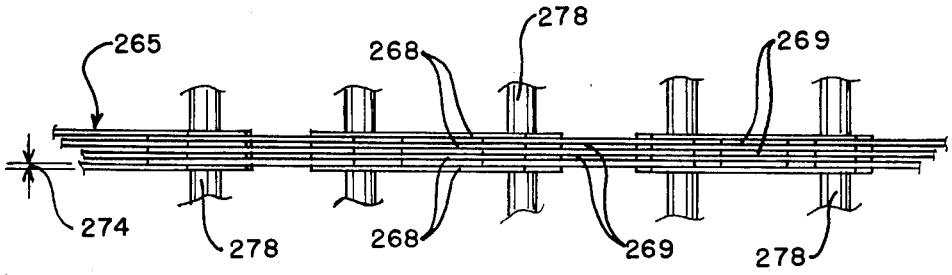
FIG. 10 shows a top view of leaves interbolted to form a portion of the grid.

Reference is made to FIG. 3. The roll assembly is comprised of a base roll member (260) having an outer circumference (262) and first (263) and second (264) circular end flanges. Circumferentially disposed along the entire outer circumference of the base roll is a circularly arcuate and cylindrically shaped grid member (265) having an outer surface (266) and an inner surface (267). The grid is made up of rows of a multiplicity of interbolted upright standing leaves (268) or segments with the rows alternately spaced so as to create a multiplicity of gaps (269) or slots therebetween on the outer surface. See FIGS. 9 and 10. Each leaf (27), typically of glass impregnated phenolic resin, is formed generally as a quadrilateral, having an upper (270) and a lower (271) longitudinal edge and a first (272) and a second 273 minor edge and is of a thickness (274) typically 0.032 inches for apple or cranberry mash which defines an identical width of the slot, between the leaves. The thickness may be varied to accommodate various types of materials for expressment. The upper and lower longitudinal leaf edges are circularly arcuate and concentric with each other such that the lower edge radius equals the radius of the base roll thereby permitting the leaf to be positioned along its lower edge radially on the outer circumference of the base roll and perpendicular to the roll's axis of rotation. Each leaf has notched centrally along its lower edge a rectangular notch (275) with its interior edge longer than its side edges and has cropped from the leaf a corner diagonally (276) from its top edge to its first minor edge to a point parallel to the interior edge of the notch such that when the leaves are assembled together alternately as in FIG. 9 and 10 the diagonal forms a funnel-like passage on the leaf leading from the slot to the interior edge of the rectangular notch situated on the next adjacent leaf. Each leaf has cut through near on either side of the notch tie rod holes (277) to receive tie rods (278) with threaded ends which are longitudinally disposed therethrough parallel to the base roll, the rods interbolt the leaves together to form the assembled grid member. When the leaves are assembled alternately on the tie rods, the rectangular notches line up in rows to form a multiplicity of channels (279) longitudinally disposed on the base roll's outer circumference along the entire length of the roll between the end flanges and which open onto matching circular passageways (280) bored in the end flange in alignment with the channels. The grid member is held by the tie rods which are passed through countersinks (281) disposed circumferentially and alternately with the passageways in the end flanges whereby the flanges may be tightened snugly and coequally to the roll assembly by nuts (282) set in the countersinks and tightened on the threaded tie rod ends. Near the outer periphery of the end flange circumferentially and spaced radially inward are cut concentrically in the end flange's outer surface first (283) and second (284) grooves of rectangular cross-section to receive "O" rings (283*a*, 284*a*) which sealingly enclose the end flanges' outer surfaces with circularly arcuate milled liquid collecting troughs (50) cut in the side bulkheads as hereinafter described.

The roll assemblies are disposed inside the side bulkheads to form a floor of a chamber (40) having two pair of opposing walls at a right angle to each other, the first pair consisting of generally isometric triangular shaped chamber plates (401) mounted upper centrally on the inner surfaces of the side bulkheads and whose equal sides (402) are circularly arcuate and have radii slightly larger than the radii of the end flanges such that the chamber plates are in sliding, sealing contact with portions of the rotating end flanges at all times, which as the flanges rotate toward each other and come in contact with the chamber plates will also form lower portions of the second pair of walls.

The chamber has a rectangular roof plate (403) having an outer surface (404) and a inner surface (405) and fits snugly, encasingly and sealingly by means of bolts (407) onto the longitudinal bulkhead tops (21) the bolts passing through a roof seal member (408) centrally disposed on the inner surface between transversely disposed bipartile battens (411) which form upper portions of the second pair of side walls, thereby enclosing the chamber from above and the sides. The roof plate has disposed therethrough ports (409) which permit the flow of mash, sludge or pulp bearing slurry from a feed pipe (410) into the chamber and onto the grid members. The batten parts when held together by holding means encase inferiorly longitudinally, flexible wipers (412) which contact the grid surfaces to contain within the chamber raw pomace and direct the pomace toward and onto the grid.

Figure 2:
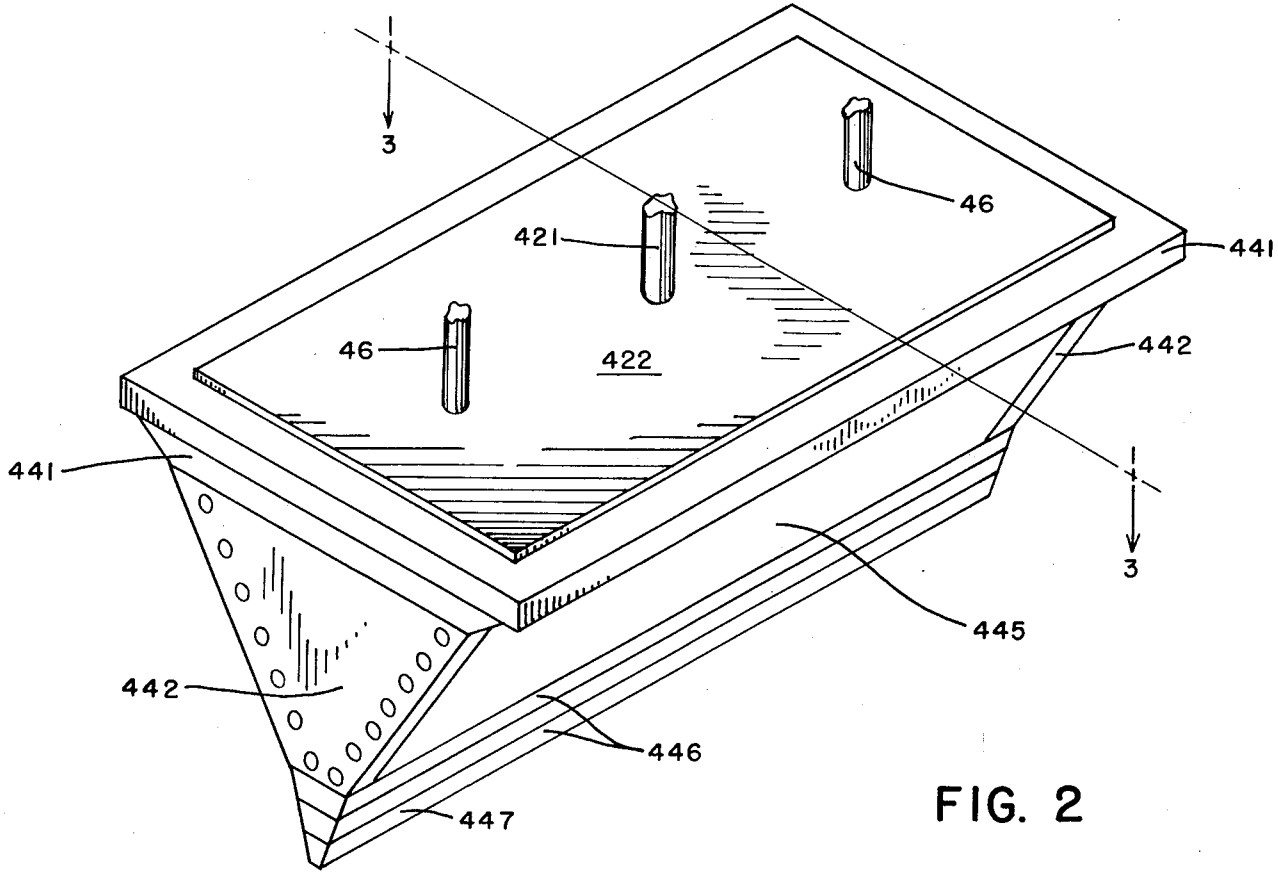
FIG. 2 shows a perspective view of a typical platen uninflated.

Centrally disposed and flange-mounted on the upper surface of the roof plate is a hydraulically driven cylinder (42) having a shaft (421) which passes through the roof plate and mounts onto a platen mounting plate (422) as in FIG. 2 and reciprocates therethrough at a defined length of stroke, for apple or cranberry mash typically one half to two inches and a defined rate of strokes per minute, typically 0.75 seconds down stroke and a dwell of 10 seconds yielding a cycle of 5.5 per minute. Attached to the platen mounting plate is a platen assembly (44) which reciprocates in conjunction therewith, at the defined rate and stroke such that the platen when in the down position as in FIG. 2 closely approaches the grid and inflates, typically for 10 seconds for mashes.

Figure 2A:
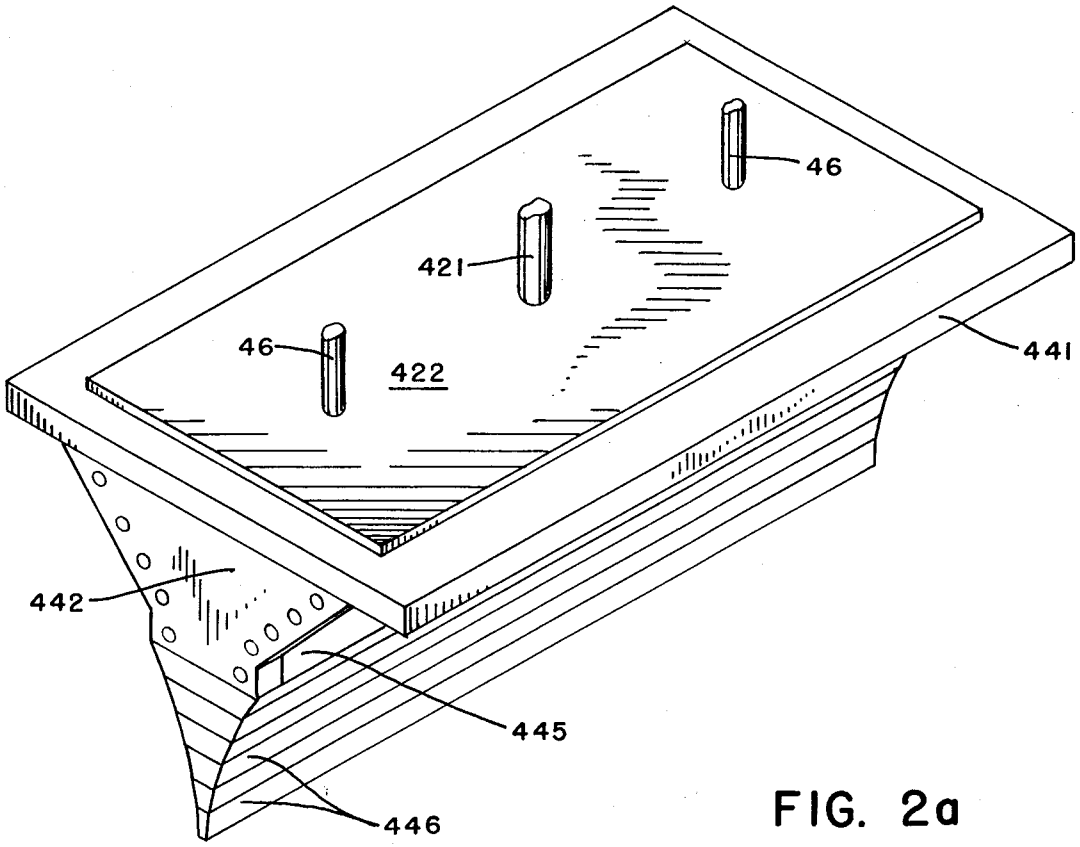
FIG. 2*a* shows a platen configuration, also uninflated, designed to create thicker compression layers of mash.

The plate assembly is generally prismatical in shape and consists of a downwardly descending multiplicity of rectangular platen plate members (441) of decreasing size to form in combination generally rectangular prism faces which approximate but are not co-equal with the curvature of the grid members' upper surfaces, and generally isometrically triangular end covers (442) to cover the plate member ends. The platen plate members are spaced apart (443) to allow for positive flow of pressurized air therebetween fed from a pressurized air line (46) disposed on the roof cover's outer surface and passing therethrough to a flexible air line leading into the platen. Fitted sealingly into a first space (443*a*) between upper larger platen plates on each longitudinal side is a longitudinal end (444) made of a rectangular sheet (445) of flexible material, typically made of rubber or neoprene, which is stretched vertically downward and sealingly fitted longitudinally into a last space (443*b*) between lower, smaller platen plate members (446, 447) and is sealed by sealing adhesive means to the platen end covers to form a bladder or expandable pouch such that when pressurized air is passed between the plates with the platen in the down position, as in FIG. 4 the pouch will expand and compress the raw material on the grid into a layer of defined, uniform thickness (102) thereagainst thereby exuding the liquid from the layer into the slots and thereafter into the channels to the passageways in the end plates, leaving substantially dry pomace (103) sludge or pulp on the grid's upper surface. A variation in the design of the plate is shown in FIG. 2*a* in which a thicker layer (102) of material will be created. As is illustrated in the drawings, the end plates 442 and the plate members 446 in FIG. 2 are substantially wider than the similar elements shown in FIG. 2*a*. As a result, when they are inserted between the roll assemblies, the wider elements of FIG. 2 will occupy more space between the rolls, compress the material undergoing treatment to a greater extent, and cause more liquid to be expressed. In this instance, however, increased compression pressure will be created at the nip point.

Further rotation of the rolls will cause the layers of material compressed thereon to come into compressing contact with each other at the nip point, causing thereby the remaining exudate to become expressed into the channels. Thereafter, the virtually dry pomace (104) will fall from the grid or be scraped therefrom by doctor blades (48) to accumulate in the bottom of the chamber onto removal means (not shown) for removal.

The rotation of the rolls will cause their end flanges to come in sealing contact with the bulkheads and the liquid collecting troughs members (50) which have exit ports (500) bored therethrough from on the inner surfaces of the side longitudinal bulkheads exteriorly, the troughs having radii equal to define the arc on which the circular passageways on the end flanges are disposed and in radial alignment therewith, and describing an arcuate trough which begins above the upper vertical and continues to past the horizontal and ends. The first and second "O" rings on the end flanges contact the bulkhead walls radially outward and inward of the troughs thereby creating a sealed environment in which solids are restrained from creeping downward alongside the end flanges when the troughs and the channels are in alignment and in sealed liquid communication with the circular passageways. This provides for liquid communication by means of tubes (501) threadingly (503) connected to the exit ports which lead to a liquid collection manifold (502) located on the exterior of the apparatus. Thereafter, the liquid passes to a bulk collection means (not shown) for further treatment. It can be understood that the exact configuration of the platen assembly can be adapted so that the platen members 446 and 447 will define a different distance from the rolls and thus define the thickness and the pressure applied to the material undergoing treatment.

As the roll continues its rotation past the troughs, it passes over oppositely disposed manifold connected washout ports (504) in line with each other in the side bulkheads through which pass pressurized washout water thereby flushing out each channel and slots connected thereto as it goes by. The wash water will drain from the apparatus into a sump (not shown) for filtration and reuse or be discharged.

As the roll continues its rotation from the washout, it passes over oppositely disposed manifold connected blowout ports (505) in line with each other in the side bulkheads through which pass live steam or clean, pressurized air thereby blowing dry each channel and its connected slots as it goes by.

The process of the preferred embodiment is carried out by pumping raw, liquid containing material (101) through the feed pipe (410) into the chamber (40) onto the grid members (265) of the roll assemblies (26). The raw material is compressed into a uniformly thick, defined layer (102) by means of the reciprocating platen assembly (44) carrying the bladders (445) which expand at the down stroke of the platen against raw material compressing it into oppositely disposed layers and expressing therefrom its liquid, substantially drying it (103) on the grid. The liquid flows through into the grid slots (269) to the channels (279) and is collected therefrom by negative pressure applied from the exterior collection manifold (503) to the liquid collecting troughs (50) in the bulkheads.

The layer is further dried by compressing it at the nip point and forcing the remaining liquid into the channels thereby.

The virtually dry material (104) is scraped from the grid surface and the channels and the slots connected thereto are washed out and blown dry by passing them by washout and blowout ports disposed in troughs on the longitudinal bulkheads situated in the line of rotation.

Since many modifications, variations and changes in detail may be made to the presently described embodiments, it is intended that all matter in the foregoing description and accompanying drawings be interpreted as illustrative and not by way of limitation.

For example, the grid assembly by virtue of its flexibility, and the leaf construction without arcs but with its diagonal leading to an adjacent channel, can readily be assembled on a flat surface or on the outer surface of a continuous belt and have the channels hooked up to or pass by the collection ports and clean outs. Installation of a vertically descending bladder to apply compression to a layer of material to be deliquified would be a variant well within the spirit of the invention.

What is claimed is:

1. An apparatus for extracting liquid from a liquid bearing material such as mash, sludge or pulp bearing slurry comprising:

a. a pair of counter-rotation rolls with solid circumferences disposed longitudinally and snugly in a chamber for rotation about a horizontal axis and spaced from each other to form a nip, each roll having circumferentially disposed thereon snugly a cylindrical grid member, the grid member comprising a multiplicity of interbolted upstanding partially overlapping leaves which are aligned in rows perpendicular to the roll axis, each leaf acting as a spacer between adjacent leaves to form slots of a width equal to the leaf's thickness which slots communicate with axially extending channels defined by the grid's inner surface, the grid being interbolted to circular end flanges disposed on the roll ends having a diameter larger than the roll and passageways bored through the end flanges connecting to the channels;

b. rotating means to counter-rotate the rolls;

c. a roof to fit sealingly over the chamber with orifice means to introduce liquid bearing material over the top of the rolls;

d. prismatically shaped platen means with rectangular faces reciprocating through the roof to a region between the rolls, said means having expandable bladders disposed on its faces;

e. inflation means to inflate the bladders toward the grid members of the rolls; and f. conduit means for applying negative pressure to the channels.

2. An apparatus for extracting liquid as in claim 1 which has in addition:

a. washout ports exteriorly mounted on the chamber to inject water and backwash the channels and slots as each rotates over such inlet;

b. drain means mounted below the rollers to remove water;

c. blowout ports exteriorly mounted on the chamber to inject pressurized gas into the channels and slots.

3. An apparatus for extracing liquid as in claim 2 wherein the pressurized gas is chosen from a class consisting of air or steam.

4. An apparatus for extracting liquid as in claim 1 wherein the leaf is made of a rigid material and is generally quadrilateral in shape having a defined thickness and having a first and second minor edge opposite and parallel to each other and an upper and lower longitudinal edge each of which is circularly arcuate and concentric with the other, the lower edge radius being equal to the radius of the counter-rotating rolls and having notched centrally therealong a rectangular notch with an interior edge longer than its side edges and there being cropped from the leaf a corner diagonally from the upper longitudinal edge to the first minor edge to a point parallel to the interior edge of the notch and there being centrally disposed on each side of the notch a tie rod hole for interbolting into the grid.

5. An apparatus for extracting liquid from a liquid bearing material such as mash, sludge or pulp bearing slurry comprising:

a. a box shaped chamber in a frame to support the chamber;

b. the chamber consisting of parallel side walls made of the frame and a front and rear wall;

c. disposed inside the chamber centrally a paid of parallel disposed rolls having circular ends which rolls rotate by rotation means toward each other past a nip point at a speed which is made variable by variable speed means, each roll having:

(A) a solid outer circumference and a first and second roll ends and mounted on a shaft attached to the side walls and;

(B) first and second end flanges bolted to the roll ends and concentric therewith and of a diameter larger than the roll and;

(C) a cylindrical grid member fitted snugly over the surface of the rolls, the grid consisting of a multiplicity of upright standing leaves in rows, in contact with each other perpendicular to the main axis of the shaft, which leaves cover the entire circumference of the roll and are interbolted to each other by tie rods whose ends are bolted to the end flanges, the leaves shaped and disposed so as to create slots of a defined width which lead to channels formed on the leaves' undersides and the roll's upper surface, the channels opening onto passageways bored through the end flanges and disposed along an arc near the periphery of the end flanges concentrically for removal of the liquid;

d. the chamber having a cover through which the liquid bearing material is fed onto the grid surfaces;

e. a prismatically shaped platen assembly consisting of rectangular plates of descending size to conform generally to the curvature of the grid such that when the platen is extended downward toward the rolls, bladders of a flexible material on the roll side faces of the platen are expanded by air under pressure passing between the plates to expand the bladders to compress the material and exude therefrom the liquid into the slots and channels to the passageways leaving layers of solid material of defined thickness disposed on the surfaces of the grids;

f. the end flanges adapted to pass in sealing relationship with arcuate troughs milled in the side walls which troughs are identical in diameter to the arc on which the passageways are disposed to establish sealed liquid communication from the channels, through the passageways and into the troughs as the rolls rotate; and g. scraping means to remove solids from the rolls after the rolls rotate past the nip.

6. An apparatus for extracting liquid as in claim 5 in which means are provided to pump flush water and to blow a pressurized gas outwardly through the channels and slots.

7. An apparatus for extracting liquid as in claim 6 wherein the pressurized gas is chosen from a class consisting of air or steam.

8. An apparatus for extracting liquid as in claim 5 wherein the leaf is made of a rigid material and is generally quadrilateral in shape having a defined thickness and having a first and second minor edge opposite and parallel to each other and an upper and lower longitudinal edge each of which is circularly arcuate and concentric with the other, the lower edge radius being equal to the radius of the parallel disposed rolls and having notched centrally therealong a rectangular notch with an interior edge longer than its side edges and there bieng cropped from the leaf a corner diagonally from the upper longitudinal edge to the first minor edge to a point parallel to the interior edge of the notch and there being centrally disposed on each side of the notch a tie rod hole for interbolting into the grid.

9. A process for extracting liquid from liquid bearing material such as mash, sludge or pulp bearing slurry comprising the steps of:

a. pumping the material into an apparatus for extracting liquid comprising:

(A) a box shaped chamber in a frame to support the chamber;

(B) the chamber consisting of parallel side walls made of the frame and a front and rear wall and (C) a pair of parallel disposed rolls having circular ends disposed inside the chamber which rolls are mounted on shafts attached to the side walls for rotation toward each other past a nip point by variable speed means, each roll consisting of:

(i) a solid outer circumference with first and second roll ends, (ii) attached to and concentric with the roll ends and of a diameter larger than the roll, (iii) a cylindrical grid member fitted snugly over and covering the roll's outer circumference, the grid member consisting of a multiplicity of upright standing leaves in rows contacting each other mounted perpendicular to the main axis of the shaft and covering the entire circumference of the roll; the leaves interbolted to each other by tie rods whose ends are bolted to the end flanges, the leaves being shaped and disposed so as to create slots of a defined width which lead to channels formed on the leaves' undersides and the roll's upper surface, the channels opening onto passageways bored through the end flanges and disposed along an arc near the periphery of the end flange concentrically for removal of the liquid;

(D) the chamber having a cover through which is fed continuously the liquid bearing material onto the grid surfaces;

(E) a prismatically shaped platen assembly consisting of rectangular plates of descending size to conform generally to the curvature of the grid such that when the platen is extended downward toward the rolls, bladders of a flexible material on the roll side faces of the platen adapted to be expanded by air under pressure passing between the plates to expand the bladders and compress the material to express liquid into the slots and channels of the circulcar passageways leaving a layer of solid material of defined thickness on top of the grid; and (F) arcuate troughs milled in the side walls which are identical in diameter to the arc on which the circular passageways are disposed;

b. spreading the materials on the grids in a layer;

c. compressing the layer on the grids a first time by expanding the bladder means;

d. expressing liquid from the materials into the slots and channels;

e. removing the liquid from the slots and channels by negative pressure;

f. rotating the rolls toward each other and further compressing the layer;

g. expressing further liquid into the slots and channels; and h. removing the compressed layer from the grid.

10. A process for extracting liquids as in claim 9 wherein the rolls in the apparatus for extracting liquid continue to rotate and pass over oppositely disposed ports in the side walls through which flush water is pumped into and through the channels and slots and then pass over oppositely disposed ports in the side walls through which is blown a pressurized gas thereby drying the slots and channels continuously.

11. A process for extracting liquid as in claim 10 wherein the pressurized gas is chosen from a class consisting of air or steam.

* * * * *